US005891535A

United States Patent [19]

Bucuk, Jr.

[11] Patent Number: 5,891,535

[45] **Date of Patent: *Apr. 6, 1999**

[54] BASE COVERING FOR CHRISTMAS TREE STAND, OR OTHER DOMESTIC OBJECTS

[76] Inventor: William Bucuk, Jr., 3 Winchester Ave., Budd Lake, N.J. 07828

[ * ] Notice: This patent issued on a continued prosecution application filed under 37 CFR 1.53(d), and is subject to the twenty year patent term provisions of 35 U.S.C. 154(a)(2).

[ * ] Notice: The terminal 6 months of this patent has been disclaimed.

[21] Appl. No.: 441,016

[22] Filed: May 15, 1995

[51] Int. Cl.[6] ..... A47G 35/00

[52] U.S. Cl. ..... 428/12; 428/19; 428/542.6; 428/542.2; D11/142; D11/143; D11/155; D11/130.1

[58] Field of Search ..... 428/19, 12, 542.2, 428/542.6, 34.2, 99, 542.8; 229/100, 103.2, 116.1, 122, 922, 116.5, 121; 217/5, 11, 65, 17, 56; D11/142, 143, 155, 130.1

[56] References Cited

U.S. PATENT DOCUMENTS

| | | | |
|---|---|---|---|
| D. 115,902 | 10/1939 | Barton | D11/130.1 |
| 1,600,687 | 9/1926 | Mantz | 229/120.23 |
| 2,461,748 | 2/1949 | Looker | 248/48 |
| 2,679,371 | 7/1954 | Meldrum | 248/44 |
| 2,956,357 | 10/1960 | Rakes | 40/457 |
| 3,333,375 | 8/1967 | Mertz | 428/542.6 |
| 4,784,314 | 11/1988 | Penick | 229/8 |

*Primary Examiner*—Stevan A. Resan
*Attorney, Agent, or Firm*—Thomas L. Adams

[57] ABSTRACT

A cover provides a facade for the base of a Christmas tree on a stand, house plant, or other domestic object. The cover includes a board that is creased and folded into a plurality of interlocking panels. The cover is formed by interlocking panels to form an open structure having a top, two sides, a front, an open back, and an open bottom. The top is notched for embracing the base. The cover thus formed can be set with the notched top embracing the base.

14 Claims, 2 Drawing Sheets

BASE COVERING FOR CHRISTMAS TREE STAND, OR OTHER DOMESTIC OBJECTS

BACKGROUND OF THE INVENTION

1. Field of the Invention

The present invention relates to covers for Christmas tree stands, house plants, or other domestic objects, and to methods for forming such covers.

2. Description of Related Art

Christmas trees are held in stands that typically have a number of support legs. The structure of this stand is not in keeping with the overall appearance and symbolism of the tree. Accordingly, people will cover the stand with blankets of various types to hide the stand. A disadvantage with such a blanket is its tendency to dip into a watering bowl underlying the tree trunk and empty the bowl by a wicking action.

Also, the inventor has modified boxes originally built with five or six sides by cutting them into a four-sided box with a notched top and an open back and bottom. Such an approach has the commercial disadvantage of requiring a consumer to purchase a bulky, preassembled box with glued seams and then cut away waste portions. Such a procedure tends to be laborious and wasteful of resources.

Known boxes have been assembled by end users from a flat cardboard cutout having a number of flaps that can fold under to form a double walled construction. Some of these boxes have interlocking double walls employing a mortise and tenon joint. Several disadvantages have been found with these existing boxes. Foremost, these lack a structure open on at least two sides to form a cover suitable for providing a facade for a Christmas tree stand or the like. Secondly, these known boxes often have unsightly corners, because the mortise and tenon joint may be externally visible. It is preferable to present instead a clean front cornice for a cover for a Christmas tree stand or the like.

Accordingly, there is a need for a simple cover that can be easily formed without unsightly joints to cover the base of a Christmas tree, house plant or other domestic objects.

SUMMARY OF THE INVENTION

In accordance with the illustrative embodiments demonstrating features and advantages of the present invention, a cover can provide a facade for a base of a Christmas tree on a stand, house plant or other domestic object. The cover includes a board shaped and adapted for folding into a plurality of interconnecting panels for forming an open box having a top, two sides, a front, an open back, and an open bottom. The top is notched for embracing the base.

According to a second aspect of the present invention a method is provided for covering with a facade, the base of a Christmas tree on a stand, house plant or other domestic object. The method employs a board adapted to be folded into a plurality of panels. The method includes the step of folding the board to form an open box having a front, two sides, a notched top, an open back, and an open bottom. the method also includes the step of setting the open box with the notched top embracing the base.

By employing such an apparatus and method, one can simply cover the base of a Christmas tree on a stand, a house plant, or similar domestic object with a facade. In the preferred embodiment, the cover is formed from a creased cardboard cutout sold disassembled and flat. Preferably, the board can be folded into a number of panels that interlock with a mortise and tenon joint so that glue, staples, or other supplementary fastening techniques are unnecessary.

The preferred board is creased to have a front region, a top region, and two side regions. The front region and top region can be folded at a crease between them to make a front cornice. The front and top regions can themselves be further folded under to meet and interlock underneath the front cornice.

Before being thus interlocked under the front cornice, side regions can preferably be folded down while a tucking wing projecting from each of the side regions can be inwardly folded to lie against and parallel with the front of the box. Thereafter, both the front region and the top region can be folded under to meet and interlock underneath the front cornice as previously mentioned. When the front region is folded under, it encloses and holds in place the tucking wings of the side region.

The exposed surfaces of the box (top, front and both sides) are preferably printed with appropriate decorative material or overlaid with a decorative paper.

BRIEF DESCRIPTION OF THE DRAWINGS

The above brief description as well as other objects, features and advantages of the present invention will be more fully appreciated by reference to the following detailed description of presently preferred but nonetheless illustrative embodiments, in accordance with the present invention, when taken in conjunction with the accompanying drawings, wherein.

DETAILED DESCRIPTION OF THE PREFERRED EMBODIMENTS

Figure 1:
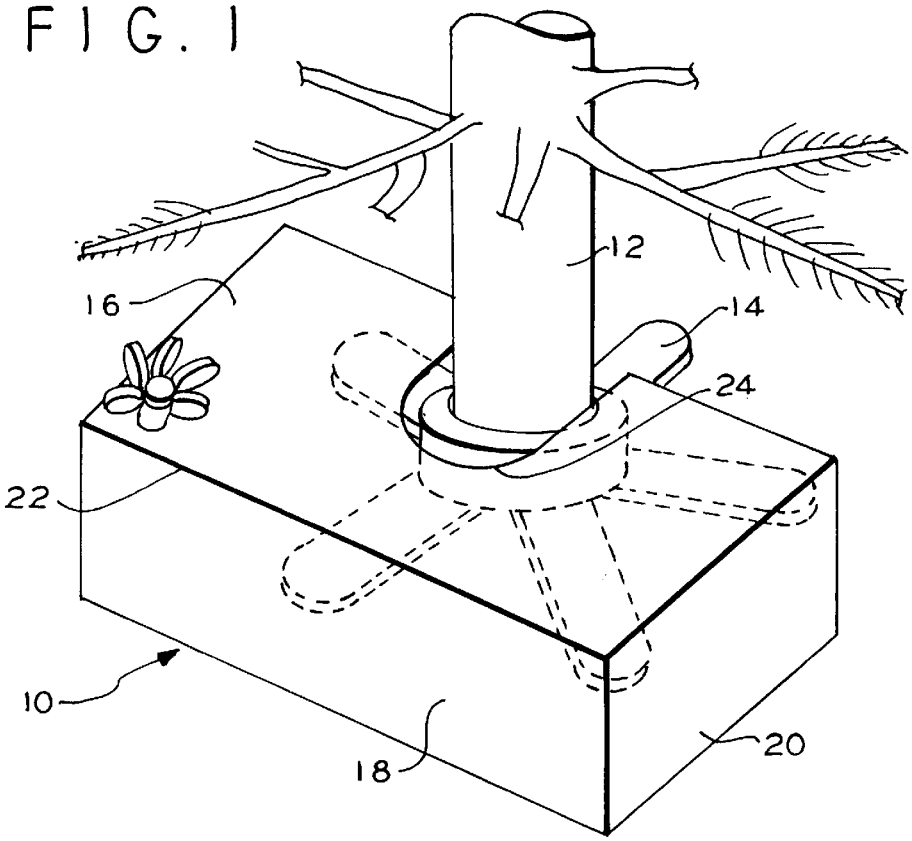
FIG. 1 is an axonometric view of a cover providing a facade for a Christmas tree on a stand, in accordance with the present invention.

Referring to FIG. 1, a cover 10 provides a facade for the base of a Christmas tree 12 mounted on a five-legged stand 14. The lower portion of the trunk of Christmas tree 12 and the stand 14 are herein referred to as a base. Alternatively, cover 10 can be used to provide a facade for a house plant or other domestic object. Cover 10 has a top 16, a front 18, and a side 20 (a hidden, complementary side is located opposite side 20). The junction between top 16 and front 18 is herein referred to as front cornice 22 (or a notchless front crease). Preferably, front cornice 22 is a smooth fold that presents a clean appearance. Top 16 is shown with a central notch 24 sized to embrace the base of the Christmas 12 in stand 14.

Cover 10 has an open back (that is, no panel exists opposite to front 18). Also, cover 10 has an open bottom (that is, cover 10 lacks an the underside panel opposite top 16).

The overall dimensions of cover 10 are 6 inches (15.24 cm) high, 21 inches (53.34 cm) wide, and 13 (33.02 cm) inches deep. The rounded notch 24 is 6 inches (15.24 cm) wide and 6 inches (15.24 cm) deep, although obviously different dimensions can be employed, depending upon the size of the base, the degree of covering required, etc.

Figure 2:
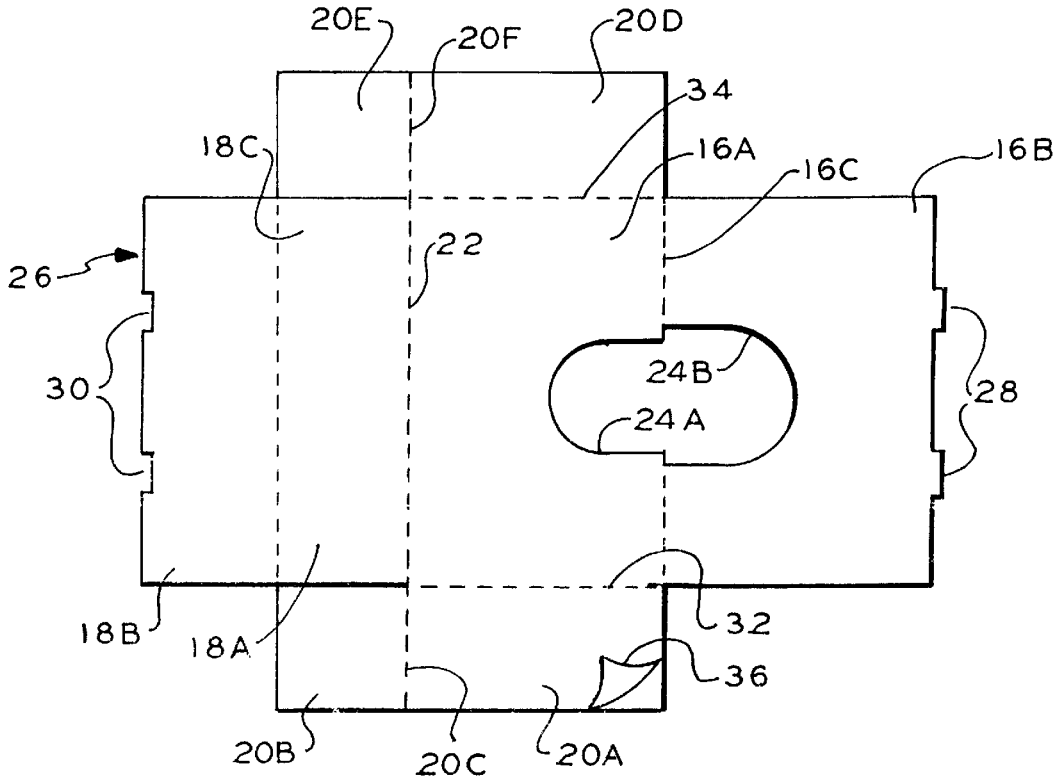
FIG. 2 is a developmental view of the board of FIG. 1, prior to folding and assembly.

Referring to FIG. 2, the previously described cover (cover 10 of FIG. 1) is illustrated before assembly as a flat board 26.

Preferably, board 26 may be a cardboard cut by a die in the fashion customary for fabricating container boxes of various types. The gauge of the cardboard can be varied depending upon the desired strength, weight, cost, etc. In this view, solid lines indicate lines that a die has cut through completely, while the dotted lines indicate areas where creases have been formed without cutting the board 26.

Board 26 is shown divided into a number of rectangles (some notched) that are herein referred to as panels, some of which are interlocking panels. The previously mentioned top (top 16 of FIG. 1) is shown herein as a top region composed of a proximal section 16A and a distal section 16B. Sections 16A and 16B are separated by a crease 16C. Crease 16C is shown with a double crease to allow folding through 180 degrees. This avoids and wrinkling or stress tears from this full fold. Sections 16A and 16B have central contiguous notches 24A and 24B that form a central hole. Notch 24B is bigger than notch 24A. As explained further hereinafter, the smaller notch will effectively cover the bigger one to conceal a double wall construction. Notches 24A and 24B will ultimately form the previously mentioned notch (notch 24 of FIG. 1).

The distal edge of distal section 16B is formed into a pair of rectangular tenons (or tabs) 28. The proximal edge of proximal section 16A is bordered by the notchless first crease 22 (previously mentioned in FIG. 1). On the opposite side of first crease 22 is a front region, composed of a proximal section 18A and distal section 18B, which are separated by crease 18C. Crease 18C is another double crease similar to crease 16C. The distal edge of distal section 18B is indented with a pair of mortises (or notches) 30.

Two side regions are illustrated: One side region is formed by external wing 20A and tucking wing 20B, which have a common border in the form of crease 20C. The other side region is composed of external wing 20D and tucking wing 20E, which have as a common border crease 20F. The border between proximal section 16A and external wings 20A and 20D are shown as creases 32 and 34, respectively.

Panels 16A, 18C, 20A and 20D may be printed with appropriate decorative material. The alternative shown here however, is covering those panels with an exterior layer, such as decorative paper 36. Paper 36 can extend to the neighboring regions to any extent desired. In addition, the layer 36 can wrap around the edges of the panels to provide a covered edge. The paper layer 36 can be printed appropriately, depending upon the type of facade contemplated.

Figure 4:
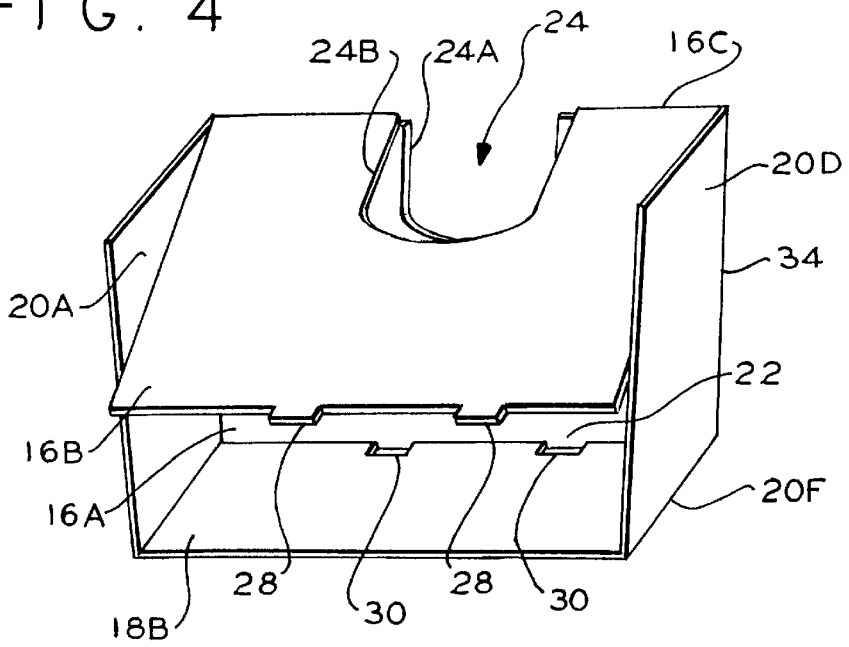
FIG. 4 is an axonometric view of the board of FIG. 3 fully assembled except for the folding under of one panel to interlock into a tenon and mortise joint.
Figure 3:
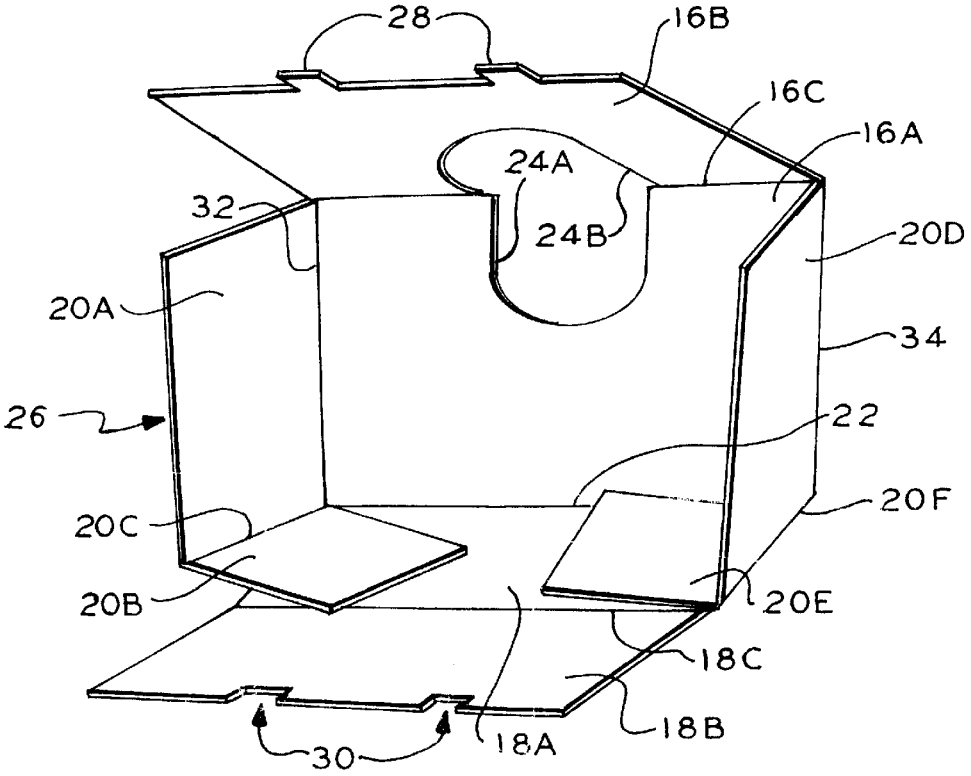
FIG. 3 is an axonometric view of the board of FIG. 2 partially folded in the course of assembly.

To facilitate an understanding of the principles associated with the foregoing cover, its assembly and use will be described in connection with FIGS. 3 and 4 as well as the other figures. In FIG. 3, the surfaces visible for board 24 are the reverse of those shown in FIG. 2 (except for the surface of panel 20D). Essentially, the board shown in FIG. 2 is flipped and all of the creases are folded concavely. In particular, creases 32 and 34 may be folded to bring panels 20A and 20D perpendicular to panel 16A. Creases 20C and 20F are folded at right angles to make panels 20B and 20A perpendicular. Once thus folded, the panels 20B and 20E can be brought approximately parallel to and flush against panel 18A. Thereafter, panel 18B can be folded over panels 20B and 20E to arrive in the position shown in FIG. 4.

Once so folded, the mortises 30 in panel 18B are located on the inside corner of the fold 22 which forms the previously mentioned upper cornice. Significantly, the mortises 30 are internal and therefore not visible. The open box can be completed by folding panel 16B under until tenons 28 snap into mortises 30. Because of the mortise/tenon construction the box can be assembled without glueing, stapling, etc. This feature is highly desirable for use as a consumer product, where assembly ought to be kept as simple as possible.

Once thus assembled, cover 10 (FIG. 1) can be set on a floor with notch 24 embracing the base of the Christmas tree 12 in stand 14. Specifically as shown in FIG. 1, notch 24 embraces the trunk of tree 12, although in some embodiments the stand itself may be embraced.

It is to be appreciated that various modifications may be implemented with respect to the above described preferred embodiments. While a board made of creased cardboard is illustrated, in other embodiments more permanent materials can be used and the creases can be formed by various types of hinges. Alternatively, in some embodiments a lighter material can be used and the crease lines can be defined by printing indicia so that the user can form creases at the time of assembly. Alternatively, separate panels can be hinged together with adhesive tape. Also, while the illustrated cover is shown as a rectangular box, in other embodiments curved surfaces, other polygonal borders, and other types of panels can be employed instead. Also in some embodiments the panels need not be self-interlocking but may be fastened by a separate fastener or may be bound together by other means. For example, self adhesive tabs may be used to assemble the cover. In still other embodiments, a pair of matching covers may be mounted on opposite sides of the tree base to cover both the front and back of the tree. While certain sides of the cover are shown double walled, in other embodiments single walls may be used. Furthermore, the various illustrated dimensions can be altered depending upon the expected size of the object to be covered.

Obviously, many modifications and variations of the present invention are possible in light of the above teachings. It is therefore to be understood that within the scope of the appended claims, the invention may be practiced otherwise than as specifically described.

I claim:

1. A facade for covering at least partially a base of a Christmas tree on a stand, house plant or other domestic object, comprising:

a cover folded into a plurality of interconnecting panels to form an open structure having a top, two sides, a front, an open back, an open bottom, and a front cornice between said front and said top, said front and said top being united by a smooth first fold without a joint visible at said front cornice, said top having opposite said front cornice a notch extending toward said front, said notch being located centrally between said two sides, so that portions of a base located in said notch and below said top can be at least partially concealed by said cover.

2. A facade according to claim 1 comprising:

a layer affixed to said front, sides and top of said open box.

3. A facade according to claim 1 wherein at least part of said cover is printed with decorative material.

4. A facade according to claim 3 comprising an ornament externally affixed to said open structure.

5. A facade according to claim 1 wherein said cover comprises at least one of corrugated cardboard, or more permanent material.

6. A facade according to claim 1 wherein said plurality of interconnecting panels are self-interlocking.

7. A facade according to claim 1 wherein said front has a second fold at the bottom in order to double said front, and wherein said top has a third fold at the back in order to double the top.

8. A facade according to claim 7 wherein portions of said doubled top and said doubled front interlock under said front cornice.

9. A facade according to claim 8 wherein portions of said doubled top and said doubled front interlock under said front cornice with an interdigitating joint.

10. A facade according to claim 7 wherein said top has a central hole extending across at least a portion of said third fold.

11. A facade according to claim 8 wherein said central hole is sized differently on opposite sides of said third fold.

12. A facade according to claim 1 wherein said notch in said top penetrates about half way to the front cornice.

13. A facade according to claim 8 wherein said cover has bordering said top an opposing pair of side regions, each being folded into an external wing and a tucking wing, said tucking wing being inyardly tucked toward the front.

14. A facade according to claim 1 wherein said cover comprises an unfolded flat blank prior to folding.

* * * * *